US007624854B2

(12) United States Patent
Zimmermann et al.

(10) Patent No.: US 7,624,854 B2
(45) Date of Patent: Dec. 1, 2009

(54) ITEM SORTING SYSTEM

(75) Inventors: Armin Zimmermann, Constance (DE); Juergen Braun, Stockach-Zizenhausen (DE); Uwe Maertin, Euless, TX (US)

(73) Assignee: Siemens Aktiengesellschaft, Munich (DE)

( * ) Notice: Subject to any disclaimer, the term of this patent is extended or adjusted under 35 U.S.C. 154(b) by 188 days.

(21) Appl. No.: 11/823,724

(22) Filed: Jun. 28, 2007

(65) Prior Publication Data

US 2008/0000752 A1 Jan. 3, 2008

(30) Foreign Application Priority Data

Jun. 28, 2006 (DE) ..... 10 2006 029 816

(51) Int. Cl.
*B07C 1/00* (2006.01)

(52) U.S. Cl. ..... 198/347.1; 209/552; 209/560; 209/584

(58) Field of Classification Search ..... 198/347.1; 209/552, 553, 555, 559, 560, 584, 900
See application file for complete search history.

(56) References Cited

U.S. PATENT DOCUMENTS 4,615,446 A 10/1986 Pavie et al.
4,778,062 A 10/1988 Pavie et al.
4,986,423 A * 1/1991 Takeda ..... 209/540
7,145,094 B2 12/2006 Oexle et al.
7,414,218 B2 * 8/2008 Wheeler et al. ..... 209/584
2007/0205143 A1 9/2007 Zimmermann et al.

FOREIGN PATENT DOCUMENTS

DE 1 078 949 B 3/1960

* cited by examiner

*Primary Examiner*—Mark A Deuble
(74) *Attorney, Agent, or Firm*—Laurence A. Greenberg; Werner H. Stemer; Ralph E. Locher

(57) ABSTRACT

An item sorting system includes at least three modules for processing items requiring sorting, a conveyor line to transport the items in a first transport path from the first to the second and to the third module, and a bypass to transport items requiring sorting in a second transport path from the first to the third module thereby bypassing the second module. A control unit sets a spacing between the items in the conveyor line upstream of the bypass as a function of an activation of the bypass. The bypass is to mitigate stresses to which items are exposed when the item sorting system is used in a plurality of passes with different functions.

10 Claims, 1 Drawing Sheet

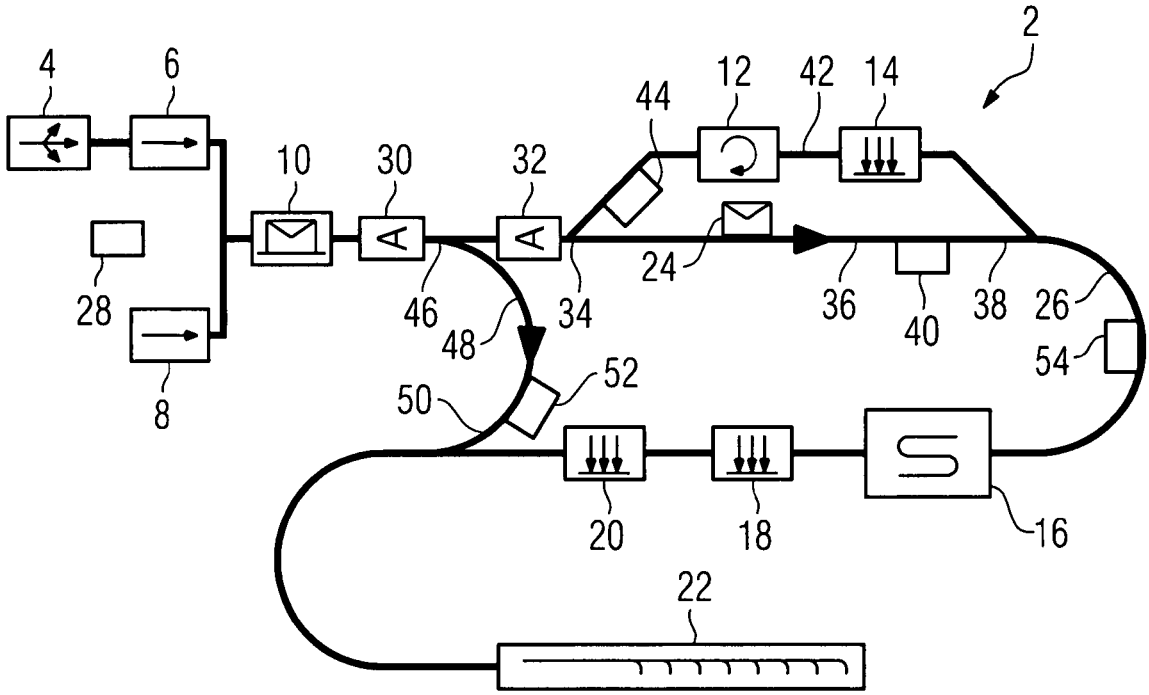
2
4
6
10
30
32
44
12
42
14
28
8
46
48
34
24
36
40
38
26
54
50
52
20
18
16
22

ITEM SORTING SYSTEM

BACKGROUND OF THE INVENTION

The invention relates to an item sorting system comprising at least three modules for processing shipping items requiring sorting and a conveyor line for transporting the items in a first transport path from the first, to the second and to the third module.

Different systems, each of which performs different functions, are known for processing items to be shipped. Thus, for example, there are systems which perform only the process of positioning the items and canceling the postage stamp, or the process of reading the address and coding, or the fine sorting process. As a result of ergonomic requirements and process requirements, however, there is an increasing demand for systems which can perform a plurality of processes. In this case the corresponding process devices are connected one after the other in series, with the shipping items passing through the entire system. If a process device is not required for a specific function, it is deactivated.

SUMMARY OF THE INVENTION

It is the object of the present invention to specify an item sorting system which handles shipping items with care.

This object is achieved by an item sorting system of the type cited in the introduction which inventively provides a bypass for transporting items requiring sorting in a second transport path from the first to the third module thereby circumventing the second module. The effect of bypassing the second module is that fewer structures are present on which mechanical stresses, in particular damage, can occur. As a result the shipping items are subjected to a lower mechanical load. In addition it is possible, by means of the bypass which circumvents the unused second module, to shorten the second transport path relative to the first transport path, as a result of which the mechanical load on the items can additionally be reduced due to the shorter transport path. It is also conceivable that although the second transport path is just as long or longer, items are still handled with greater care if the second module is bypassed, so a more gentle treatment of the items is achieved nonetheless.

The invention is based on the further idea that different sorting processes can be performed in separate passes on one item sorting system. For example, a system for reading addresses and coding the items is used in a first pass for reading, coding and presorting into collecting containers, and in a second pass the system is used as a fine sorting machine which sorts the coded and presorted items once again into collecting containers, albeit according to finer criteria. The modules for reading and coding can be circumvented in the second pass by means of the bypass, as a result of which the items are handled with greater care.

The shipping item sorting system can be a postal item sorting system, in particular a letter item sorting system. A module in this context can be understood to denote a means for modifying the item, for example in terms of its position—apart from a pure, destination-oriented transport—or in terms of its components, e.g., by printing. A module can be a means for positive or negative acceleration, for sorting, aligning, rotating, printing, labeling, delaying, e.g., a queuing section, separating ("singling"), collecting or the like, and can be in particular a means which puts the items under greater stress than a spatially destination-oriented transport.

The conveyor line also comprises the bypass which circumvents a conveyor sub-line of the conveyor line. The bypass itself comprises a conveyor sub-line which is expediently shorter than the conveyor sub-line circumvented by the bypass. The bypass is advantageously free of a module which is the same as the second module or similar thereto. A sorting by the item sorting system is also understood to signify a processing of the shipping items in the form of a preparation for sorting, for example by applying a sorting code such as an identity code, a destination code or the like. A subdividing of the items into at least two containers is also understood as sorting. The item sorting system advantageously comprises a control unit for activating the bypass and steering the items through the bypass. By this means a decision as to whether an item stream is to run through the bypass can be automated and in particular linked with protection functions.

In an advantageous embodiment of the invention the item sorting system comprises a control unit which permits a routing of an item stream from a plurality of items arranged one immediately after another into the bypass and blocks a routing of only individual items from the item stream into the bypass—with other items of the item stream being routed past the bypass. In this way a collision of items downstream of the bypass can be easily avoided.

A collision of items can likewise be easily avoided if the item sorting system comprises a control unit for controlling different system operating modes and for activating the bypass as a function of the system operating mode. The item sorting system can be easily operated without items flowing both via the bypass and past the bypass. Consequently, the items cannot collide downstream of the bypass. The items can be routed by the control unit via the bypass in one system operating mode and past the bypass in the other system operating mode. A changeover between the operating modes is expediently only controlled when both the bypass and the conveyor sub-line circumvented by it are free of items, in particular only during an idle phase of the conveyor line or before or after a transportation of items by means of the conveyor line.

In a further advantageous development of the invention the item sorting system comprises a control unit for setting a spacing between the items in the conveyor line as a function of an activation of the bypass. By this means a small spacing between the items can be set when the bypass is activated and consequently a high item throughput rate through the item sorting system can be achieved. This embodiment is based on the idea that as a result of the bypassing of the second module and the consequently achievable lower loading during the transport, the items are displaced to a lesser extent relative to one another. Because of the smaller displacement the spacings of the items from one another, e.g., during feeding into the conveyor line, can be reduced. With the bypass activated, the spacing is therefore less than with a deactivated bypass. By reducing the spacings an increase in the throughput of items through the item sorting system can be achieved at the same transport speed. The spacing is expediently set in a feeder of the item sorting system which individually separates ("singles") the items.

It is also proposed that the item sorting system comprises a control unit for deactivating a conveyor sub-line circumvented by the bypass as a function of an activation of the bypass. The wear and tear to which the switched-off conveyor sub-line is exposed can be kept low and noise emissions can be reduced. With the conveyor sub-line deactivated, the item sorting system also requires less energy. A simple deactivation of the conveyor sub-line can be achieved if the item sorting system comprises two drives for driving the conveyor line which can be operated independently of each other, with the control unit for deactivating the conveyor sub-line circumvented by the bypass being provided by a deactivation of one of the drives. In addition or alternatively, with the bypass activated, the second module circumvented by the bypass can be switched off, as a result of which the wear and tear on the second module and its energy consumption can be reduced.

The modules of the item sorting system can have different functions. Thus, for example, the first module may be a feeder for separating loads into single items and feeding them to the conveyor line, the second module may be a printer for printing an identity code or destination code on the items, and the third module may be a subdividing device for allocating the items to different collecting containers. The maximum speed at which the items can be transported through the system can in this case be determined by the second module, for example the printer, which specifies the upper speed limit of the transport on the basis of its print speed. In a circumventing of the second module by means of the bypass it can happen that this upper speed limit is no longer relevant, but instead another module specifies a higher upper speed limit, thus enabling the speed of the items through the system to be increased. In order to set the expediently optimal transport speed of the items, the item sorting system advantageously comprises a control unit for setting a transport speed of the items in the conveyor line as a function of an activation of the bypass. Depending on the properties of the bypassed module or the bypassed modules, a maximum transport speed can be set automatically and an optimal throughput of the system achieved.

Images of handwritten addresses are usually output online to an employee who reads the address and enters it into a computer so that the corresponding item can be coded according to the input. For this purpose a small time interval is required in which the item is transported in a transport section for generating a time delay between the read module and the coding module. A transport section of this kind can be 40 m or more in length and have a plurality of curves. If the second module is a transport section for generating a time delay, by bypassing this module it is possible to reduce the exposure of the items to stresses to a substantial degree. In this case the processing function of the module is the time delay and expediently not primarily a transport to a destination, since the transport section in particular is longer than a technically expedient transport path between modules which it links. The transport section can be embodied as a single part or divided into multiple parts, i.e., interrupted by further modules.

The vast majority of supplied items are typically already presorted and require no further alignment into a common orientation. In order to sort these items, a second module which has an aligning means for aligning the items into a common orientation can advantageously be circumvented by means of the bypass.

In a further refinement of the invention the second module has a labeling means for labeling the items. Said module can expediently be bypassed in a second pass in which no further coding has to be performed. The labeling means can be a postage stamp canceling device or an identification printer, e.g., a barcode printer.

If the second module has a recording means for recording an image of the items, in a second pass in which addresses are already present in machine-readable form, said recording means can advantageously be circumvented by means of the bypass.

As described above, item sorting systems can be used with a plurality of modules in a plurality of passes for different functions or sorting methods. For this purpose the item sorting system advantageously comprises a control unit for controlling at least two different sorting methods and for activating the bypass as a function of the sorting method that is to be performed. Depending on sorting method, for example first the sorting method of reading the addresses and coding and then the sorting method of fine sorting, one or more bypasses can be easily, in particular automatically, activated, thereby exposing the items to less stress.

In order to avoid a complicated and error-prone merging of items from two transport sub-lines into a common conveyor sub-line, the item sorting system advantageously comprises a control unit which blocks a switchover from the first to the second transport path when items are contained in a conveyor sub-line circumvented by the bypass. For example, a switchover between the transport paths may be allowed only at the beginning of a sorting operation, or a switchover can only be performed after a waiting time which is long enough to ensure that within this time all the items from the conveyor sub-line to be bypassed have been conveyed out of said conveyor sub-line.

BRIEF DESCRIPTION OF THE SEVERAL VIEWS OF THE DRAWINGS

The invention is explained in more detail with reference to an exemplary embodiment which is shown in a drawing with a single FIGURE, which shows in a schematic representation an item sorting system comprising a number of modules for processing items.

DETAILED DESCRIPTION OF THE INVENTION

The figure shows in a schematic representation an item sorting system 2 comprising a number of modules 4, 6, 8, 10, 12, 14, 16, 18, 20, 22 for processing items 24 requiring sorting at a conveyor line 26 for transporting the items 24. The module 4 is a presorting device into which the items 24 are input by the bagful and which separates out too large, too small, too thick or too inflexible items 24 and only allows standard letters to pass through. Said letters are brought to the module 6 which comprises a singling device, also referred to as a feeder, which individually separates the items 26 and between them sets a spacing specified by a control unit 28. The control unit 28 is connected for control purposes to all the modules 4, 6, 8, 10, 12, 14, 16, 18, 20, 22 as well as to further components of the item sorting system 2.

The items thus separated into single items are pinched between two elastic belts by the conveyor line 26 and transported to the module 10 which is implemented as an aligning unit and aligns the items 24 by their lower edge as they pass. The items 24 are then guided by the conveyor line 26 without interruption past a reader device 30, for example a barcode reader and address reader which reads a barcode possibly present on items 24 or an address printed onto the items 24. Since the items 24 coming from the module 6 usually bear no barcode and certain items 24 have handwritten addresses which cannot be recognized by the reader device 30, the items 24 are guided along by the conveyor line 26 past an image recording device 32 which records images of both sides of the items 24 in a bitmap format and supplies them to the control unit 28. The control unit 28 sends images of those items 24 whose address is not machine-readable online to a reading center (not shown) in which the images are output on screens and read by staff who enter at least parts of the address via a keyboard. This data is forwarded online to the control unit 28.

In the further course of the sorting method the items 24 are fed to the module 12 embodied as an aligning means which brings the items 24 into a uniform orientation, for example so that the address on all the items 24 is head up and the stamp is aligned in the transport direction. The authenticity of the stamp is then verified in the module 14 and the stamp is canceled.

All the items 24 are now supplied to the module 16 which is embodied as an approximately 50 m long transport section for generating a time delay of about 14 seconds. As a result of this delay the reading staff has several seconds in order to input the read address via the keyboard before the items 24 reach the module 18 embodied as a labeling means which prints a barcode onto the non-machine-readable items 24. Said barcode indicates at least a part of the address of the respective item 24, which address is consequently machine-readable. In a module 20 likewise implemented as a labeling means, a forwarding label is attached to items 24 for whose address a forwarding order is present, said forwarding label subsequently being printed with the forwarding address. Finally the items 24 are conveyed by the conveyor line 26 to the module 22 which is a subdividing device and roughly distributes the items 24 into a plurality of containers according to their address, for example 100 zip codes per container in each case. Also conceivable as a module 22 for processing the items 24 is a subdividing device for splitting into only two collection points or an item collecting means for feeding to a further sorting process.

The item sorting system 2 also comprises with the module 8 a second feeder for individually separating ("singling") items 24 which are supplied already prepared by companies. Said items are already uniformly aligned and provided with a postage paid stamp, so they no longer require processing by the modules 12 and 14. In a further system operating mode the item sorting system 2 can therefore be fed by the module 8 in which the control unit 28 activates a corresponding switch 34 which guides the items 24 into a bypass 36 and hence past the modules 12 and 14. The bypass 36 comprises a conveyor sub-line 38 which is driven by a separate drive 40, with the result that when the bypass 36 is activated the control unit 28 can set the conveyor sub-line 38 in motion and when the bypass 36 is deactivated the control unit 28 can bring the conveyor sub-line 38 to rest. A conveyor sub-line 42 which supplies the modules 12, 14 is likewise assigned a separate drive 44 which—depending on the status of the bypass 36—can be switched on or switched off.

The bypass 36 can be activated by the control unit 28 if the item sorting system 2 is loaded with correspondingly uniformly oriented and canceled items 24, not by the module 6, but solely by the module 8. In this case the system operating mode is switched over and the modules 12, 14 and the drive 44 are switched off by the control unit 28. However, there is also the possibility that the module 8 loads the item sorting system 2 automatically if the module 6 has large loading gaps, for example if the presorting device is currently operating at no load. In this case the control unit 28 waits until there are no more items in the conveyor sub-line 42 and then activates the new system operating mode and hence the module 8 and the bypass 36. As long as the conveyor sub-line 42 is not free of items 24 the control unit 28 blocks the bypass 36. With such a brief activation of the bypass 36, the modules 12, 14 remain in operation and the drive 44 remains in motion. If the module 6 reports a new loading requirement, for example after a manual filling, the control unit 28 switches over the system operating modes once again.

In a second pass controlled by the control unit 28, the item sorting system 2 can be used in a further system operating mode for fine sorting, e.g., for fine sorting of the items 24 presorted previously in the first pass as described above. The containers filled with items 24 are then taken from the module 22 and the items 24 contained therein passed into the feeder of the module 8 which once again individually separates ("singles") the items 24 and feeds them to the conveyor line 26. These items 24 are all uniformly oriented, canceled and provided with a machine-readable address or an identity code which is read by the reader device 30. Consequently the modules 12, 14, 16, 18 and 20 are not required for further fine sorting. A switch 46 is therefore set by the control unit 28 such that a second bypass 48 is activated which comprises a conveyor sub-line 50. The latter is driven by a separate drive 52 and can therefore be driven or, as the case may be, shut down independently of the other parts of the conveyor line 26. If the items are guided in the transport path via the bypass 48 in a second pass, the modules 12, 14, 16, 18, 20, the drives 40, 44 and a further drive 54 are switched off, with the result that the corresponding part of the item sorting system 2 is in an idle state and the item sorting system 2 runs quietly and at a low level of wear and tear.

A spacing between the items 24 is also set in the feeder of the module 8, said spacing being smaller than a spacing between items 24 which pass through the modules 16, 18 and 20. The typical throughput of the item sorting system 2 is calculated according to the following equation:

$$\begin{aligned} \textit{Throughput} &= \text{transport speed}/(\text{item length} + \text{spacing}) \\ &= 3.5\ \text{m/s}/(200\ \text{mm} + 80\ \text{mm}) \\ &= 45{,}000\ \text{items/hour.} \end{aligned}$$

Owing to the approximately 3 m long bypass 48, more than 50 m of transport section and a pass through the modules 16, 18, 20 are avoided, as a result of which the spacing can be set 20 mm less. This yields a throughput of $$\begin{aligned} \textit{Throughput} &= 3.5\ \text{m/s}/(200\ \text{mm} + 60\ \text{mm}) \\ &= 48{,}461\ \text{items/hour} \end{aligned}$$

and hence an increase of 3,461 items per hour, which is equivalent to about 8%.

During full operation of the item sorting system 2, the maximum transport speed is determined by the printer of the module 20. If the modules 18, 20 are deactivated when the bypass 48 is active, the control unit 28 sets the transport speed of the items 24 faster in accordance with other conditions, as a result of which the throughput of the item sorting system 2 can additionally be increased.

What is claimed is:

1. An item sorting system comprising:

at least three modules for processing items requiring sorting;

a conveyor line configured to transport said items in a first transport path from the first to the second and to the third module;

a bypass configured to transport items requiring sorting in a second transport path from the first to the third module thereby bypassing the second module;

a singling device configured for individually separating the items; and a control unit configured to set a spacing between the items in the conveyor line upstream of the bypass as a function of an activation of said bypass, said singling device for setting the spacing specified by said control unit as a function of an activation of said bypass.

2. The item sorting system of claim 1, wherein said control unit is configured to control different system operating modes and activate the bypass as a function of the system operating mode.

3. The item sorting system of claim 1, wherein said control unit is configured to deactivate a conveyor sub-line circumvented by the bypass as a function of an activation of said bypass.

4. The item sorting system of claim 1, wherein the second module is a transport section for generating a time delay.

5. The item sorting system of claim 1, wherein the second module has an aligning means for aligning the items into a common orientation.

6. The item sorting system of claim 1, wherein the second module has a labeling means for labeling the items.

7. The item sorting system of claim 1, wherein the second module has a recording means for recording an image of the items.

8. The item sorting system of claim 1, wherein said control unit is configured to control at least two different sorting methods and to activate the bypass as a function of the sorting method that is to be performed.

9. The item sorting system of claim 1, wherein said control unit blocks a switchover from the first to the second transport path when items are contained in a conveyor sub-line circumvented by the bypass.

10. An item sorting system comprising:

at least three modules for processing items requiring sorting;

a conveyor line configured to transport said items in a first transport path from the first to the second and to the third module;

a bypass configured to transport items requiring sorting in a second transport path from the first to the third module thereby bypassing the second module; and a control unit configured to set a spacing between the items in the conveyor line upstream of the bypass as a function of an activation of said bypass, said control unit being configured to set a transport speed of the items in the conveyor line as a function of an activation of the bypass.

* * * * *